US006666552B2

(12) United States Patent
Anderson et al.

(10) Patent No.: US 6,666,552 B2
(45) Date of Patent: Dec. 23, 2003

(54) DIAPHRAGM/CHECK VALVE USED IN INKJET CASSETTE TO AIR REMOVAL FOR EXTENDED LIFE STORAGE

(75) Inventors: Stephen A. Anderson, Thompson Station, TN (US); Bruce S. Jones, Franklin, TN (US); William A. Putman, Franklin, TN (US)

(73) Assignee: Seiko Epson Corporation, Nagano-Ken (JP)

( * ) Notice: Subject to any disclaimer, the term of this patent is extended or adjusted under 35 U.S.C. 154(b) by 0 days.

(21) Appl. No.: 10/148,982

(22) PCT Filed: Oct. 5, 2001

(86) PCT No.: PCT/US01/31266

§ 371 (c)(1),
(2), (4) Date: Jun. 4, 2002

(87) PCT Pub. No.: WO02/28648

PCT Pub. Date: Apr. 11, 2002

(65) Prior Publication Data

US 2003/0076392 A1 Apr. 24, 2003

Related U.S. Application Data

(60) Provisional application No. 60/239,084, filed on Oct. 6, 2000.

(51) Int. Cl.[7] ..... B41J 2/175

(52) U.S. Cl. ..... 347/86

(58) Field of Search ..... 347/84, 85, 86, 347/87

(56) References Cited

U.S. PATENT DOCUMENTS

| | | | | | |
|---|---|---|---|---|---|
| 4,514,742 | A | * | 4/1985 | Suga et al. | 347/85 |
| 5,040,002 | A | * | 8/1991 | Pollacek et al. | 347/87 |
| 5,801,737 | A | * | 9/1998 | Sato et al. | 347/86 |
| 5,847,735 | A | * | 12/1998 | Betschon | 347/86 |

* cited by examiner

*Primary Examiner*—Anh T.N. Vo
(74) *Attorney, Agent, or Firm*—Squire, Sanders & Dempsey L.L.P.

(57) ABSTRACT

An ink cartridge (10) for dispensing ink (IK) having a housing (12) with a cavity (22) therein for storing a quantity of ink, and a dispensing port (26) for delivering the ink to an output recordation device, such as a printer. The housing further has one or more additional ports (32, 34) extending through the housing in fluid communication with the cavity, and a check valve (16) received in one of the additional ports. The check valve is adapted to permit fluid flow in substantially one direction.

15 Claims, 3 Drawing Sheets

DIAPHRAGM/CHECK VALVE USED IN INKJET CASSETTE TO AIR REMOVAL FOR EXTENDED LIFE STORAGE

CROSS-REFERENCE TO RELATED APPLICATIONS

This application claims priority from Provisional Application No. 60/239,084 filed on Oct. 6, 2000.

BACKGROUND OF THE INVENTION

This invention relates to the art of cartridges for dispensing ink, and more particularly, to cartridges for dispensing ink that use a reduced-pressure area in the cartridge to more efficiently use the capacity of the cartridge, to increase the shelf life and quality of the ink dispensed, and to minimize leakage from the cartridge by minimizing the volume and pressure of extraneous fluids (e.g., air) retained in the cartridge and in the ink therein.

Cartridges for dispensing ink have been provided heretofore, and generally are comprised of a housing having a cavity therein for storing a quantity of ink, and a dispensing port extending through the housing from the cavity through which ink may flow. Such a cartridge is operatively associated with an output recordation device, such as a printer. Typically, the printer has a printhead, and the dispensing port is in fluid communication with the printhead so that ink can be transferred from the cavity in the cartridge to the output medium, such as paper.

A housing generally has a top wall, such as a cover, that extends across the top of the housing to fully enclose the cavity. The cover is secured to the housing forming a fluid-tight seal along a seam between the housing and the cover. One or more ports, in addition to the dispensing port, may extend through the housing to permit the ingress and egress of ink or air. Once the cover has been secured to the housing and the cartridge has become a generally closed container, the cartridge is filled with ink. At various stages throughout this filling process, the dispensing port and other ports will be sealed to prevent leakage and evaporation of the ink.

In ink cartridges of the foregoing character, air may be retained in the cartridge during the filling process. The trapped air can mix into the ink during the filling process or after the filling process. This can reduce the storage life of the ink cartridge, result in interruption of ink flow from the cartridge and lead to a reduction in the quality of output from a printer using such a cartridge. Air trapped in the cartridge may expand in response to temperature or pressure changes and thereby undesirably force some of the stored ink from the cartridge. To minimize such print voids or other problems, ink cartridges are often filled in a reduced-pressure environment. A variety of difficulties are encountered when employing such a filling procedure. The filling operation often requires expensive equipment to perform the filling operation under these conditions. Sealing the port in a conventional manner, such as by plugging or covering the ports, does not overcome the problem of air entrapped in the cartridge either prior to or during the filling process. Furthermore, once the cartridge has been sealed in a conventional manner, there is no way to remove entrapped air from the cartridge. As such, it will be appreciated that filling cartridges in this manner can be difficult and inefficient, often requiring expensive equipment to effectively perform such filling operations, and may still lead to a reduction in the quality of ink cartridges.

BRIEF SUMMARY OF THE INVENTION

In accordance with the present invention, an ink cartridge is provided that avoids or minimizes the problems and difficulties encountered with ink cartridges of the foregoing nature, while promoting the desired simplicity of structure, economy of manufacture, ease of assembly, and maintaining the quality of ink stored and dispensed in association with such ink cartridges.

More particularly, in this respect, ink cartridges according to the invention include a housing having a cavity therein for the storage of a quantity of ink. A dispensing port extends through the housing from the cavity such that ink may be dispensed through the port. The housing has a top wall, such as a cover, extending there across and enclosing the cavity. In the present embodiment, the top wall is in the form of a cover and is secured to the housing by welding, bonding or adhesive, for example, forming a fluid-tight seal with the housing. In addition to the dispensing port, the housing may have one or more additional ports extending therethrough placing the cavity in fluid communication with the ambient atmosphere. One of the additional ports, the vacuum port, is fitted with a check valve that permits the flow of fluid through the port in substantially one direction.

The check valve is supported on the cartridge adjacent the vacuum port, and permits fluid to flow from the cavity inside the cartridge out through the port without permitting substantial flow of fluid in the reverse direction, that is, flow of fluid into the cavity from the ambient atmosphere.

An arrangement of the vacuum port and check valve according to the subject invention includes an elastomeric check valve having a body portion and a valve portion, and a vacuum port having a retaining portion and a fluid-passage portion. The body portion of the check valve is housed in the retaining portion of the vacuum port such that the fluid-passage portion remains substantially unobstructed. The valve portion of the check valve extends from the body portion along the exterior of the housing beyond the fluid-passage portion of the vacuum port and engages an external surface of the housing forming a fluid-tight seal between the valve portion and the external surface.

Accordingly, the present invention advantageously provides a cartridge for dispensing ink in which the ink is stored under a reduced pressure relative to the ambient atmosphere, and the cartridge includes a check valve that facilitates removal of air trapped in the cartridge after the filling process.

Other advantages of the invention reside in improved print quality and operation, as well as extended shelf life of the ink cartridge.

Furthermore, an ink cartridge of the foregoing character is comprised of a minimum number of parts and is structurally simple, thereby promoting and maintaining the economical production of the ink cartridge.

Still other benefits and advantages will become apparent to those skilled in the art upon reading and understanding the following detailed description.

DETAILED DESCRIPTION OF THE PREFERRED EMBODIMENT(S)

Figure 1:
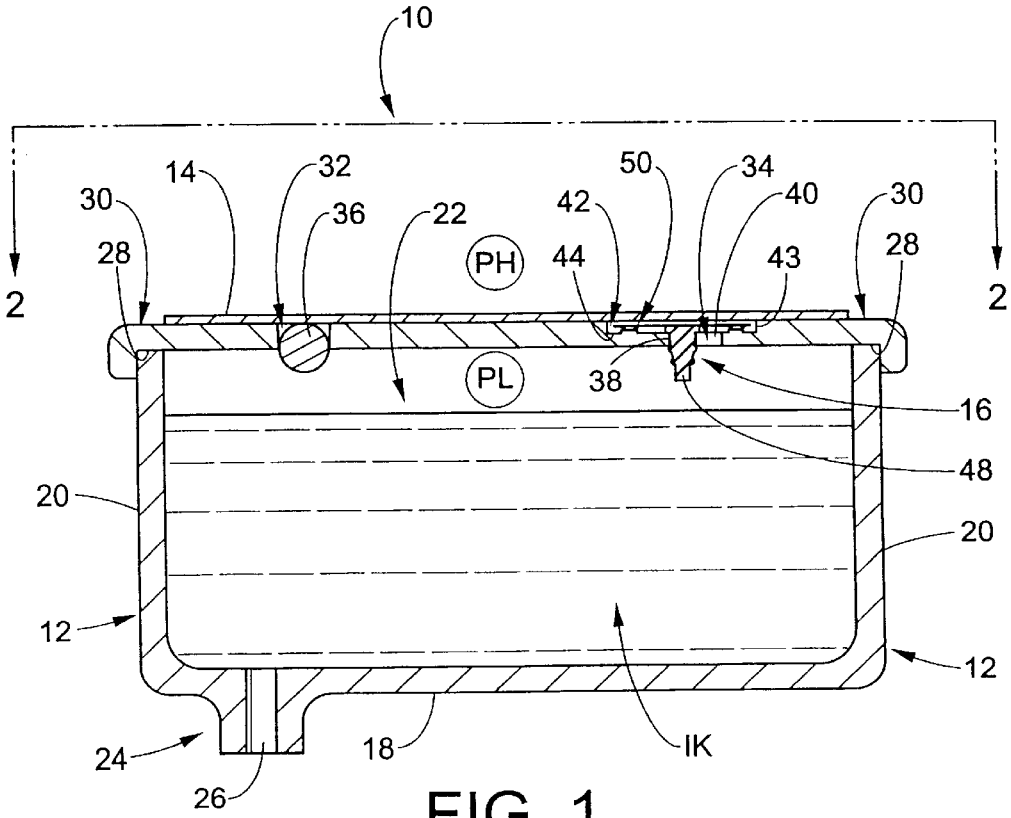
FIG. 1 is a cross-sectional elevation view through on embodiment of an ink cartridge in accordance with the present invention.

Referring now in greater detail to the drawings, wherein the showings are for the purpose of illustrating preferred embodiments of the invention only, and not for the purpose of limiting the invention, FIG. 1 illustrates an ink cartridge 10 having a housing 12, a seal member 14 extending along the exterior of housing 12, and a check valve 16 supported on housing 12 and between the housing and seal member 14.

Housing 12 includes a bottom wall 18 and side walls 20 extending from bottom wall 18 and defining a cavity 22 therebetween. Extending from bottom wall 18 opposite cavity 22 is a tube-like member or chimney 24. Extending through chimney 24 from cavity 22 is a dispensing port 26. Sidewalls 20 of housing 12 terminate at top edge 28. A cover 30 engages top edge 28 of housing 12 and encloses the cavity 22. Cover 30 is permanently attached or fused to top edge 28 of housing 12 and a fluid-tight seal is formed between the cover and the housing. It will be appreciated that attachment may be made by any one of a variety of suitable methods, such as welding, bonding or gluing. It will be further appreciated that ink cartridges are generally well known and may including housings having a top wall in a form other than the illustrated cover.

Figure 2:
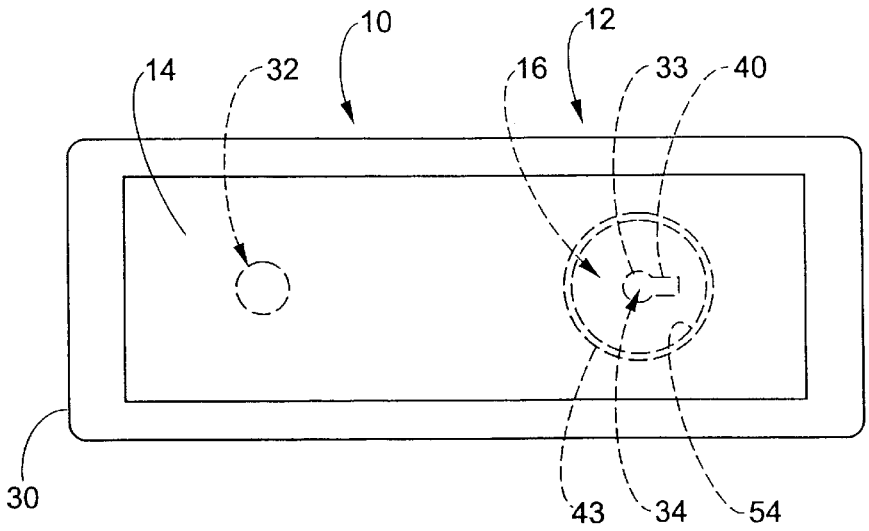
FIG. 2 is a plan view of the ink cartridge shown from the direction of line 2—2 of FIG. 1.

In addition to dispensing port 26, housing 12 includes a fill port 32 and a vacuum port 34. Fill port 32 may be of any one of a variety of configurations suitable for receiving a fill nozzle for injecting a quantity of ink IK into cavity 22 of housing 12. Fill port 32 may be closed off or sealed by a plug 36 after the fill operation has been completed. Vacuum port 34 is shown in FIG. 2 as having a keyhole shape that includes a valve-retaining portion 38 and a fluid-passage portion 40. It will be appreciated that vacuum port 34 may take any one of a variety of shapes or configurations suitable for both retaining check valve 16 and providing a passage for fluid through cover 30 from cavity 22. Such configurations may include a vacuum port having a plurality of separate passages, one or more of which may be used to retain check valve 16 while others are utilized as a fluid passage. Cover 30 also includes a recess 42 adjacent vacuum port 34 and having an inside peripheral wall 43 and a base wall 44. In the current embodiment, a seal-engaging surface 46 extends from base wall 44, and may be integrally formed from the same material as cover 30 or may be formed from a separate or different material and attached to cover 30. Additionally, it will be appreciated that in other embodiments seal engaging surface 46 may be eliminated, or the surface may be recessed into base wall 44. It will be further appreciated that seal engaging surface 46 may have a portion having refined surface characteristics for improving engagement with valve portion 50 of check valve 16, such as a reduced roughness, a reduced amount of contamination or foreign deposits, or a coating extending over the surface.

Figure 3:
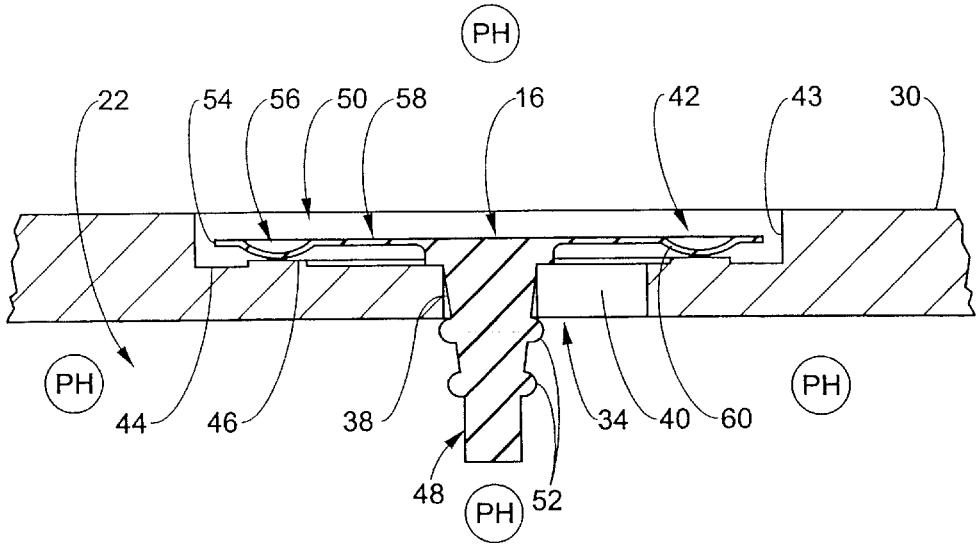
FIG. 3 is an enlarged partial view of the ink cartridge shown in FIG. 1 with the check valve in the closed, sealed position.
Figure 4:
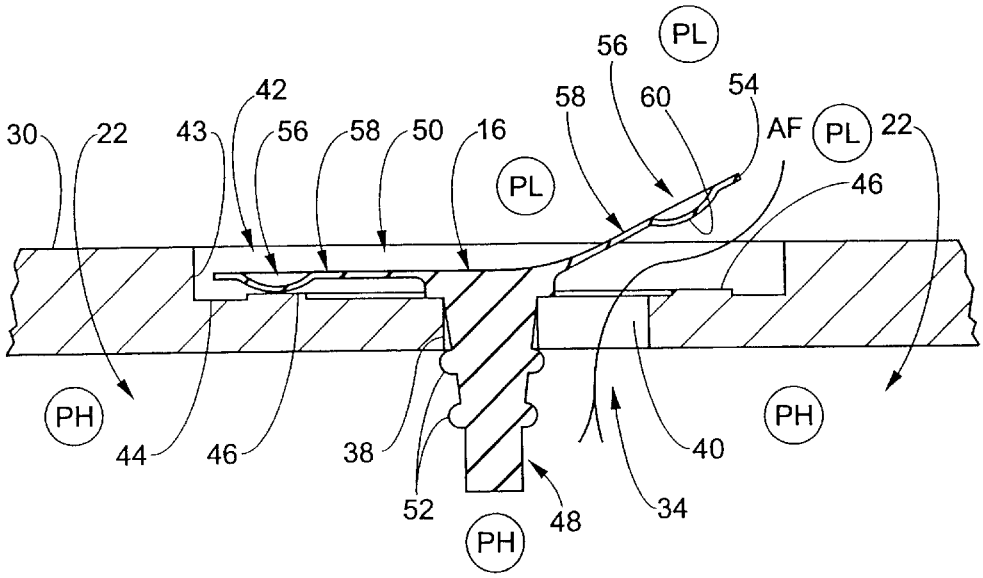
FIG. 4 is an enlarged, partial view of the ink cartridge shown in FIG. 1 with the check valve shown in the open, unsealed position.
Figure 5:
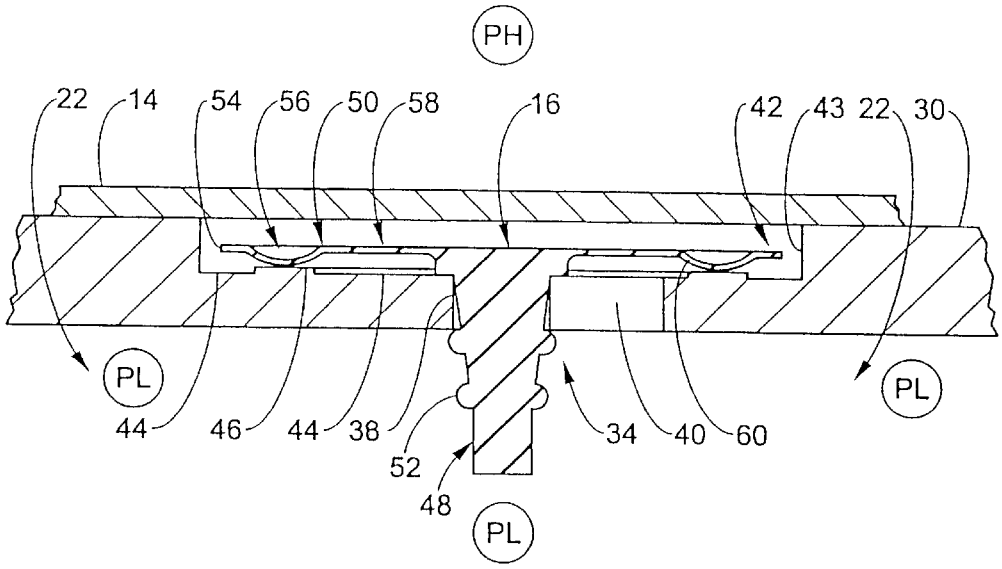
FIG. 5 is an enlarged, partial view of the ink cartridge shown in FIG. 1 with the check valve shown in a closed, sealed position and further including a sealing member extending over the check valve.

As is more particularly shown in FIGS. 3–5, check valve 16 includes a body portion 48 and a valve portion 50. Body portion 48 extends into valve-retaining portion 38 of vacuum port 34. Retaining members 52 extend from body portion 48 and retain check valve 16 in vacuum port 34 due to the outside diameter of retaining members 52 being larger than the inside diameter of valve-retaining portion 38. It will be appreciated that retaining portion 38 and retaining members 52 may be of any one of a wide variety of configurations suitable for preventing the unintentional removal of check valve 16 from vacuum port 34. Furthermore, check valve 16 may be formed from any one of a variety of materials. In the embodiment disclosed, check valve 16 is formed from an elastomeric material, such as silicon rubber.

Valve portion 50 of check valve 16 extends outwardly from body portion 48 and terminates at an outside peripheral wall 54. Valve portion 50 of the check valve includes a seal portion 56 and a web portion 58. In the embodiment shown in FIGS. 3–5, the valve portion of the check valve is annular in shape and seal portion 56 circumferentially extends about valve portion 50 radially inwardly of peripheral wall 54. Web portion 58 of the valve portion extends from the body portion 48 and connects the seal portion 56 thereto. It will be appreciated that the valve portion may take the form of any one of a variety of shapes or sizes.

In the embodiment shown in FIGS. 3–5, seal engaging surface 46 of base wall 44 extends circumferentially about the vacuum port 34. Seal portion 56 is positioned adjacent surface 46 and includes a sealing surface 60 that contacts the seal-engaging surface 46. Fluid-passage portion 40 of vacuum port 34 extends radially inwardly of the seal formed between sealing surface 60 of the seal portion and seal-engaging surface 46 of the base wall such that check valve 16 fluidically isolates the vacuum port 34 and cavity 22 from the ambient atmosphere external to ink cartridge 10. In the present embodiment, the sealing surface 60 is a circumferentially extending curvilinear surface. However, it will be appreciated that sealing surface 60 may take any one of a variety of suitable forms without deviating from the principles of the subject invention.

In operation, as shown in FIG. 3, the valve portion is biased toward a closed, sealed position in which the sealing surface 60 engages seal-engaging surface 46 forming a fluid-tight seal therebetween. As shown in FIG. 4, the induction of a reduced-pressure area PL external to ink cartridge 10 adjacent seal member 14 and vacuum port 34 causes the deflection of valve portion 50 due to the differential pressure. The air retained in high-pressure area PH will be removed through fluid-passage portion 40 of vacuum port 44 along the path indicated by arrow AF. Once the cavity has been sufficiently evacuated, the valve portion 50 returns to the closed, sealed position, as shown in FIG. 5, again forming a fluid-tight seal between sealing surface 60 and seal-engaging surface 46. Once the valve portion 50 has returned to the closed, sealed position, a reduced-pressure area PL, relative to ambient, will exist within cavity 22 of cartridge 10 and be maintained and isolated from the ambient atmosphere PH outside ink cartridge 10 by the seal formed between sealing surface 60 and seal-engaging surface 46. The flexural properties of the check valve 16 bias valve portion 50 toward the closed, sealed position. Additionally, the differential pressure between the ambient atmosphere outside the ink cartridge and the reduced-pressure area inside cavity 22 of ink cartridge will further bias the valve portion toward the closed, sealed position. To minimize any further chance that fill port 32 or vacuum port 34 will leak and allow the passage of air into cavity 22 or permit ink to evaporate or otherwise leak from the ports, seal member 14 extends across cover 30 of housing 12 to cover these ports. Seal member 14 may be welded, bonded or glued to cover 30, and may be formed from a material such as a plastic, an elastomer, or a metallic foil that is typically heat sealed to the cover.

While considerable emphasis has been placed herein on the structures and structural interrelationships between the features of the embodiment disclosed, it will be appreciated that other embodiments of the invention can be made and that many changes can be made in the embodiments illustrated and described without departing from the principles of the invention. For example, the check valve may be constructed as illustrated in the drawings from other elastomer materials, or the device may be alternately manufactured from other materials such as metal, plastic or a composite material. Accordingly, it is to be distinctly understood that the foregoing descriptive matter is to be interpreted merely illustrative of the present invention and not as a limitation.

Having thus described the preferred embodiment(s), the invention is now claimed to be:

1. A cartridge, for dispensing ink used in association with an output recordation device, said cartridge comprising:

a housing having a cavity therein for storing a quantity of ink, a dispensing passage in communication with said cavity through said housing for transferring the ink from said cavity, and a vacuum port extending through said housing placing said cavity in fluid communication with ambient;

a one-way check valve operatively associated with said vacuum port, said check valve being selectively operable to effect a fluid transfer from said cavity to ambient while fluidically isolating ambient from said cavity;

said check valve includes a body portion and a valve portion extending from said body portion, said valve portion being positioned adjacent and operatively associated with said vacuum port of said housing, and said body portion of said check valve being received in said vacuum port; and wherein said body portion extends at least partially into said cavity and includes a retaining member extending therefrom inside said cavity, said retaining member having a cross-sectional area greater than a cross-sectional area of said vacuum port.

2. A cartridge, for dispensing ink used in association with an output recordation device, said cartridge comprising:

a housing having a cavity therein for storing a quantity of ink, a dispensing passage in communication with said cavity through said housing for transferring the ink from said cavity, and a vacuum port extending through said housing placing said cavity in fluid communication with ambient;

a one-way check valve operatively associated with said vacuum port, said check valve being selectively operable to effect a fluid transfer from said cavity to ambient while fluidically isolating ambient from said cavity;

said check valve includes a body portion and a valve portion extending from said body portion, said valve portion being positioned adjacent and operatively associated with said vacuum port of said housing, and said body portion of said check valve being received in said vacuum port; and wherein said inside peripheral wall includes a retaining portion and a fluid-passage portion, and said body portion of said check valve is received in said vacuum port adjacent said retaining portion of said inside peripheral wall such that said fluid-passage portion is substantially unobstructed by said body portion of said check valve.

3. A cartridge as in claim 2, wherein said check valve is elastomeric.

4. A cartridge as in claim 2, wherein said housing includes a cover at least partially enclosing said cavity.

5. A cartridge as in claim 4, wherein said cover includes said vacuum port.

6. A cartridge as in claim 2, wherein said valve portion of said check valve is defined by an outside peripheral wall, and said valve portion includes a web portion and a seal portion.

7. A cartridge as in claim 6, wherein said seal portion extends between said outside peripheral wall and said body portion of said check valve.

8. A cartridge as in claim 7, wherein said web portion extends between said seal portion and said body portion of said check valve.

9. A cartridge as in claim 2, wherein said housing has a recess with a base wall surrounding said vacuum port, and said valve portion of said check valve engages said base wall to form a fluid-tight seal.

10. A cartridge as in claim 9, wherein said seal portion has a circumferentially extending curvilinear surface, and said surface engages said base wall to form a fluid-tight seal.

11. A cartridge as in claim 9, wherein said base wall of said recess has a seal-engaging portion, and said valve portion of said check valve engages said seal-engaging portion to form a fluid-tight seal.

12. A cartridge as in claim 9 further including a sealing member, said-housing having an exterior surface from which said recess extends, and said sealing member extending along said exterior surface adjacent said vacuum port to at least partially cover said recess.

13. A cartridge as in claim 12, wherein said sealing member is formed from foil.

14. A cartridge for dispensing ink used in association with a printer, said cartridge comprising:

a housing having an exterior surface, an interior surface at least partially defining a cavity for storing a quantity of ink, a dispensing passage extending through said housing in communication with said cavity for transferring the ink from said cavity, and a vacuum port extending through said housing in fluid communication with said cavity;

a check valve operatively associated with said vacuum port, said check valve being selectively operable to effect a fluid transfer from said cavity to ambient while fluidically isolating ambient from said cavity; and wherein said vacuum port is defined by an inside peripheral wall having a retaining portion and a fluid-passage portion, said check valve having a body portion, and said body portion being received in said retaining portion of said inside peripheral wall such that said fluid-passage portion is substantially unobstructed by said body portion of said check valve.

15. A cartridge as in claim 14, wherein said body portion of said check valve includes a retaining member extending into said cavity from said body portion, said retaining member having a cross-sectional area greater than a cross-sectional area of said vacuum port.

* * * * *